United States Patent [19]

Sack

[11] 4,055,003

[45] Oct. 25, 1977

[54] METHOD AND APPARATUS FOR ALTERING THE RIGIDITY OF WEBS BY OSCILLATION

[75] Inventor: Georges H. Sack, Lisle, Ill.

[73] Assignee: Johnson & Johnson, New Brunswick, N.J.

[21] Appl. No.: 608,426

[22] Filed: Aug. 28, 1975

[51] Int. Cl.[2] ..... F26B 13/20

[52] U.S. Cl. ..... 34/155; 34/156; 302/31

[58] Field of Search ..... 34/155, 156, 160; 226/97; 302/31, 29

[56] References Cited

U.S. PATENT DOCUMENTS

| | | | |
|---|---|---|---|
| 559,498 | 5/1896 | Scharrer | 34/160 |
| 927,995 | 7/1909 | Morrow | 34/156 |
| 1,560,589 | 11/1925 | Andrews et al. | 34/156 |
| 2,037,806 | 4/1936 | Little | 226/97 |

FOREIGN PATENT DOCUMENTS

| | | | |
|---|---|---|---|
| 992,577 | 5/1965 | United Kingdom | 34/156 |

*Primary Examiner*—John J. Camby
*Assistant Examiner*—Larry I. Schwartz

[57] ABSTRACT

An apparatus is provided which is suitable for treating a web so as to modify the properties of the web. The apparatus includes a wall means which defines an elongated tunnel having an inlet end and an outlet end. Gas stream deflectors such as an array of spaced baffles, contoured surfaces, or the like, are positioned in the tunnel along opposing walls thereof. Two substantially parallel gas streams are passed through the tunnel in the direction of web travel. The gas streams flow on opposite sides of the web, impinge on the deflector means and oscillate and support the web. As each gas stream is deflected, it is directed against the web so that the web undergoes mechanical bending and oscillation which results in an alteration of bending stiffness, drape, feel and hand of the web.

A method for modifying the properties of the web contemplates providing a confined flow passageway having an inlet and an outlet, introducing the web into the passageway, introducing a pair of gas streams into the passageway only at the inlet end of the passageway, passing the gas streams through the passageway on each side of the web so that the web is supported by the gas streams and transported through the passageway, and periodically altering the direction of flow for each gas stream in the passageway so that each gas stream alternately impinges onto and deflects a portion of the web as the web is transported through the passageway.

16 Claims, 10 Drawing Figures

A
B

METHOD AND APPARATUS FOR ALTERING THE RIGIDITY OF WEBS BY OSCILLATION

BACKGROUND OF THE INVENTION

This invention relates to method and apparatus for altering the rigidity of fabrics and other web-like materials.

It is desirable to improve the softness, hand, drape aesthetic characteristics, and reduce the material bending stiffness of fabrics or the like without deleteriously affecting other properties thereof. Unfortunately, most of the existing equipment in the textile and nonwoven industry exerts physical pressure on the material in process. As a result, the treated material may have increased density and/or reduced loft in conjunction with any softening or improved drape that may result. Moreover, existing methods for softening fabrics usually undesirable reduce fabric surface integrity due to physical contact of the processing equipment with the fabric surfaces.

Several prior art patents relate to drying, fixing, setting or reducing a treated or coated web of textile material without injury to the web or to the applied treatment by air-conveying the material over the necessary distance without frictional support or any physical contact that would tend to injure the web or the applied treatment. For example, U.S. Pat. No. 3,662,476 to Capizzi discloses an apparatus for drying web from printing devices wherein a plurality of nozzles on one side of the web are staggered relative to a plurality of nozzles on the opposite side of the web which leads to the formation of waves in the web as it moves through the apparatus. The web enters a housing through an inlet and exists through an outlet. The nozzles are provided with extensions defining air discharge openings whereby streams of air can be applied to the web by means of the extensions. The air streams develop at least some flow which is transverse to the direction of the web movement, however, which transverse flow tends to disrupt the flow of air longitudinally in the direction of air movement, thereby reducing the tendency for air to move out of the dryer, reducing the demand on the exhaust means and reducing the inflow of atmospheric air through the inlet and outlet openings. The air streams do not exist through the outlet, do not carry the web from the inlet to the outlet, and do not control the feed of the web.

In U.S. Pat. No. 3,287,821 to Schregenberger, a web is supported by a plurality of air jet streams in registration on opposed walls of the air-conveying apparatus. The air jet streams are positioned at points which occur at intervals which minimize undulation or possible vibration that may injure the web material or a surface applied treatment. The air is substantially recovered and reused. Rather than entering and exiting the apparatus at locations where the web enters and exits, each air jet stream air is in the form of an undulating air stream, and the incidence of web impingement is based on the number of air inlets and outlets that are present. The web itself does not undergo oscillation.

In U.S. Pat. No. 1,847,915 to Bailey, a coated web is dried by passing the web between a pair of air streams which alternately approach and leave the surfaces of the web due to alternate contractions and expansions of the duct through which the air flows. However, the contractions and expansions are not staggered, and the web does not oscillate.

SUMMARY OF THE INVENTION

The present invention provides an apparatus which is suitable for treating a web so as to modify the properties of the web. The web, comprising a fabric, nonwoven or woven web, paper tissue, pulp board or other suitable material, has its physical characterisics altered to reduce bending stiffness, to improve drape and softness, and to increase feel and hand by aerodynamic means. The apparatus can further be used to dry and moisture-condition webs, to remove lint from the surface of a fabric, or to soften pulp board prior to fluffing in a disintegrator. This is accomplished by supporting a web between a pair of substantially concurrent gas steams in a confined flow passageway and causing said gas streams to oscillate the web by impingement thereon. The gas streams are introduced through suitable feed means only at the same end of the apparatus and at a location where the web enters, i.e., the inlet end. The gas streams exit at the opposite end of the apparatus at a location where the web exits. In the confined flow passageway the gas streams are deflected against the web in a manner which can be adjusted to control the treatment to which the web is to be subjected. The volume and pressure of each gas stream preferably can be independently adjustable. The web is self-feeding due to the action of the gas streams in carrying the web through the apparatus. The gas deflector means in the tunnel can be stationary or movable baffles, contoured or undulating inner wall surfaces, and the like.

A method for modifying the properties of a web in accordance with the present invention comprises the steps of providing a confined flow passageway having an inlet and an outlet, introducing the web into the passageway, introducing a pair of substantially concurrent gas steams into the passageway only at the inlet end thereof, passing a gas stream through the passageway on each side of the web so that the web is supported by the introduced gas streams and transported through the passageway, and periodically altering the instantaneous direction of flow for each gas stream within the passageway so that each gas stream alternately impinges onto and deflects, and as a result oscillates, the web as the web is transported through the passageway.

DESCRIPTION OF THE PREFERRED EMBODIMENTS

In the description, where three digit numerals are used to refer to the various embodiments, the same last two digits in each numeral are used to designate similar structural elements.

Figures 1, 2, 3, 4, 5, 6:
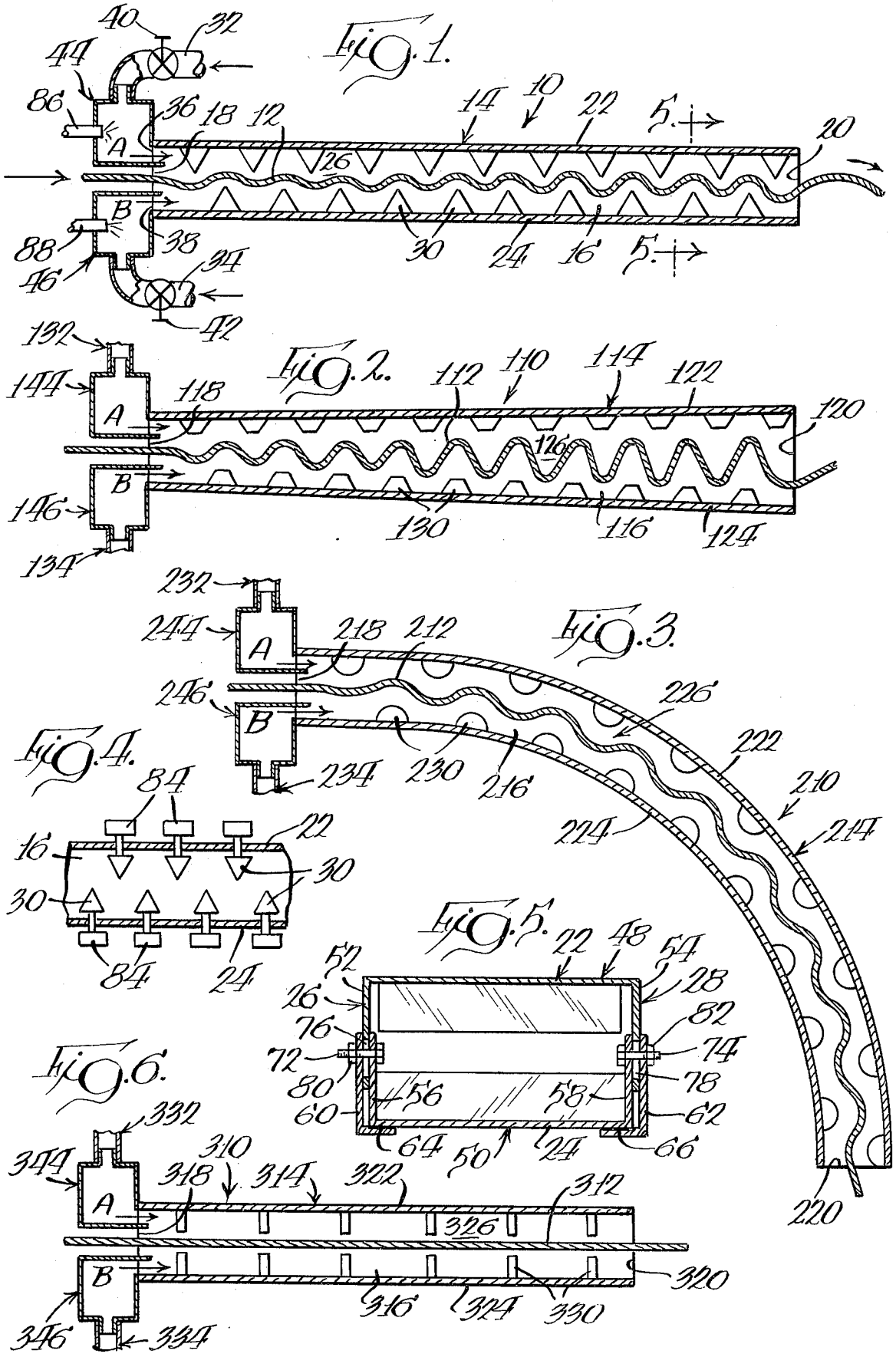
FIG. 1 is a cross-sectional elevation of one embodiment of the apparatus of the present invention.
FIG. 2 is a cross-sectional elevation of another embodiment of the apparatus of the present invention illustrating the use of a diverging passageway or tunnel.
FIG. 3 is a cross-sectional elevation of yet another embodiment of the apparatus of the present invention illustrating the use of a curved passageway.
FIG. 4 is a fragmentary cross-sectional view of a baffle-actuating means in accordance with yet another embodiment of the present invention.
FIG. 5 is an enlarged cross-sectional view taken along plane 5—5 in FIG. 1.
FIG. 6 is a cross-sectional view of a further embodiment of the present invention.
Figure 7:
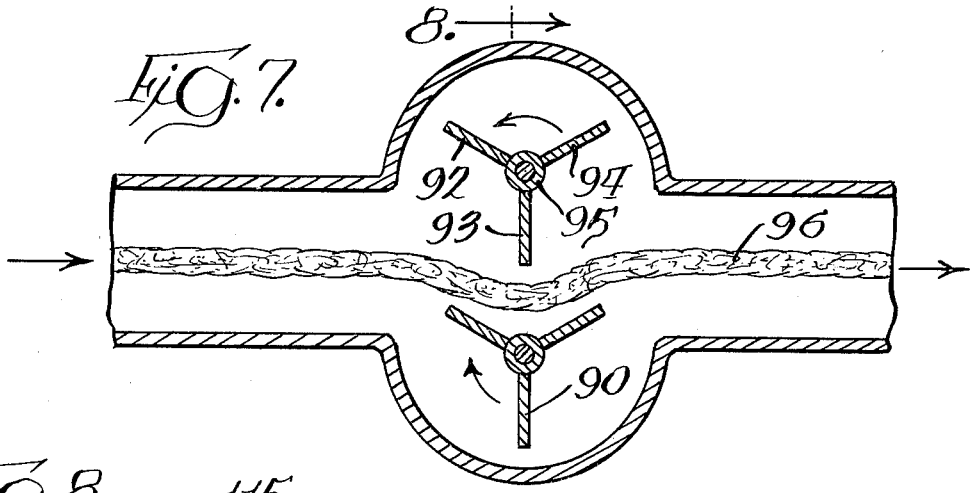
FIG. 7 is a fragmentary cross-sectional view showing an embodiment of the present invention which utilizes a set of rotating baffles.

Referring to FIGS. 1 and 5, web treatment apparatus 10 is shown receiving for treatment a woven or nonwoven fibrous web segment from a supply role, such as web segment 12, which may be fabric, pulp board, or other flexible materials. Web segment 12 is mechanically bent and vibrated by gas streams as it is transported through apparatus 10 so as to alter the bending stiffness, feel and hand thereof. Apparatus 10 includes wall means 14 which define an elongated tunnel or confined flow passageway 16 having inlet end 18 and outlet end 20. Wall means 14 include an elongated top wall 22, an elongated bottom wall 24, and first and second elongated sidewall means 26 and 28 which are generally perpendicular to the top wall 22 and bottom wall and which define a tunnel together with walls 22 and 24. Web segment 12, i.e., that part of the web which is situated in the tunnel at any point in time, can be conveyed to and from the tunnel by means of rollers or similar means (not shown) in any convenient manner. An array of spaced impingement baffles 30 is positioned in tunnel 16 along opposing wall surfaces thereof so that the baffles along top wall 22 are staggered relative to the baffles along bottom wall 24. Baffles 30 can have any suitable contour. For example, baffles can be flat plates (FIG. 6), or in the shape of wedges (FIG. 1), truncated triangular prisms (FIG. 2), semi-cylinders (FIG. 3), or rotatable paddle wheels (FIG. 7). Alternatively, top wall 22 and bottom wall 24 can be fabricated from a corrugated sheet to provide walls having integral contoured inner surfaces for deflecting a gas stream impinging thereon.

The baffles are positioned along top wall 22 and bottom wall 24 and may be in registration (FIG. 6) relative to an opposing baffle but are preferably spaced offset from each other as illustrated in FIGS. 1-3. The baffles along top wall 22 are preferably parallel to one another and the baffles along bottom wall 24 are also preferably parallel to one another. Baffles 30 preferably have a height which is less than one-half of the transverse dimension between top wall 22 and bottom wall 24, but can be lower if desired.

Apparatus 10 is further provided with first and second gas feed means which includes conduits 32 and 34 (FIG. 1) positioned only at the inlet end 18 of tunnel 16 for introducing two substantially concurrent gas streams into tunnel 16. The net flow of the gas streams through tunnel 16 is in the direction of arrows A and B from inlet end 18 to outlet end 20 where the streams are exhausted to atmosphere; however, the instantaneous direction of flow for each gas stream in the tunnel is periodically altered by the action of the baffles as well as the web segment in the tunnel. The gas streams are positioned on opposite sides of web segment 12 and support web segment 12 in tunnel 16. Thus, one of the gas steams flows between web segment 12 and top wall 22 and impinges against one array of baffles, i.e., the baffles 30 on top wall 22, while the other gas stream flows between web segment 12 and bottom wall 24 and impinges against the other array of baffles, i.e., the baffles 30 along bottom wall 24.

Gas to conduits 32 and 34 is supplied by means of a blower or the like (not shown). Conduits 32 and 34 communicate with inlet 18, through gas flow control means such as valves 40 and 42 for adjusting both the volume and/or the pressure of each gas stream and thus the velocity thereof, and plenums 44 and 46 from which the gas streams enter into tunnel 16 through plenum orifices 36 and 38, respectively. Each valve 40, 42 is positioned between the blower and inlet 18, and is associated with one of the gas streams. Valves 40 and 42 may be independently variable to individually adjust the pressure of each gas stream. By independently controlling the pressure and volume of the top and bottom gas streams, different effects can be created on the materials being treated. For example, one of the gas streams can be periodically interrupted to obtain different degrees of softening by impact vibration.

By an appropriate selection of the shape and spacing of the baffles, the distance between each array of baffles and the opposing tunnel walls, the volume and pressure of the gas streams, and the shape or configuration of the tunnel, the present apparatus can be made of self-feeding at any desired web feed rate.

The concurrent gas streams enter tunnel 16 only at inlet end 18 thereof. The length of tunnel 16 is not critical and is selected depending on the extent of treatment desired for the material and the desired web processing rate. It is important, however, to maintain web segment 12 under a predetermined minimum tension while traveling through the tunnel in order to obtain the maximum effect of aerodynamic flexing.

Web segment 12 is fed into tunnel 16 and concurrent gas streams are introduced therein. The gas streams pull web, segment 12 through tunnel 16 in the direction of arrows A and B. The offset relationship of baffles 30 along top wall 22 and bottom wal 24 causes the gas streams to periodically deflect portions of web segment 12 and flow along a tortuous path thereby generating waves in or oscillating web segment 12. The gas streams carry web segments 12 generally along a tortuous path through tunnel 16 from the inlet end 18 to the outlet end 20, curving between baffles 30. The web segment undergoing treatment is supported by the gas streams during the oscillation, and the web segment passing through tunnel 16 undergoes bending and vibration. The resulting mechanical working of the web produces an alteration of the bending stiffness and other properties. Since web segment 12 is supported between the two concurrent gas streams, there is little, if any, contact of the web segment with the baffles 30, thus the possibility of surface damage to web segment 12 during treatment is minimal. Inasmuch as web segment 12 is fed or transported without being compressed, web segment 12 experiences no reduction in loftiness which would be experienced with other mechanical means of softening. Thus, apparatus 10 provides a simple and economical means of imparting improved softness, hand, drape and other characteristics to a web segment, is easy to install in normal production lines, and is capable of carrying a web segment at speeds in excess of 300 feet per minute.

The spacing, shape and registration of baffles 30 can be adjustable. Furthermore, the distance between baffles 30 and the tunnel wall opposite thereto can be adjusted to vary the degree of oscillation and to thereby control the characteristics which are imparted to web segment 12. For this purpose wall means 14 may comprise a pair of U-shaped members 48 and 50, (FIG. 5), with member 48 including top wall 22 and sidewalls 52, 54, and member 50 including bottom wall 24 and sidewalls 56, 58 partially overlapping sidewalls 52, 54 of member 48. L-shaped brackets 60, 62 can be welded or otherwise secured to member 50, as at 64, 66. Sidewalls 52, 54 of member 48 are positioned between sidewalls 56, 58 of member 50 and L-shaped brackets 60, 62. L-shaped brackets 60, 62 and sidewalls 56, 58 of member 50 have suitable apertures (not shown) adapted to receive mounting screws 72, 74. The head end of screws 72, 74 abuts sidewalls 56, 58. Each sidewall 52, 54 of member 48 is provided with an elongated slot 76, 78 which receives screws 72, 74 so that sidewall 52, 54 can be moved with respect thereto. Nuts 80 and 82 are positioned on the outermost ends of screws 72, 74 and can be tightened to abut against L-shaped brackets 60, 62 and to pull brackets 60, 62 against respective sidewalls 52, 54 so as to secure members 48 and 50 in the desired position.

The distance between adjacent spaced baffles 30 can also be altered to control the bending curvature that web segment 12 will undergo in tunnel 16, the periods of web oscillation, and the degree of tortuosity in the path of web segment 12.

Baffles 30 can be stationary. However, as shown in FIGS. 4 and 7, the baffles may be rotated, oscillated, or otherwise moved as the web is transported through the passageway to further vary the characteristics imparted to the web and/or to vary the severity of treatment to which the web is subjected.

Referring to FIG. 4, baffles 30 can be provided with motors, or actuators 84 for imparting a rotary, reciprocating, or oscillatory motion thereto, thereby altering the direction of flow of the gas streams through tunnel 16 and modifying the nature of the oscillations imparted to the web segment moving over baffles 30. Actuators 84 can cause baffles 30 to rotate or oscillate in a plane parallel to top and bottom walls 22 and 24, respectively, thereby periodically reducing and again increasing the available impingement surface for the gas streams passing through tunnel 16. Likewise, baffles 30 can be oscillated in a plane parallel to the general direction of the gas flow in tunnel 16, thereby varying the angle of impingement and thus deflection for the gas streams, or baffles 30 mounted on opposing walls of tunnel 16 can be reciprocated toward and away from one another thereby varying the amplitude of the oscillations imparted to the web.

A further embodiment of this invention utilizing movable baffles is illustrated in FIG. 7. A set of opposed baffles in the form of rotatable paddle wheels 89 and 90 each having a plurality of radially-extending, peripherally-spaced blades, are mounted within tunnel 91 and are adapted to be rotated in synchronism so that a web segment moving therebetween is subjected to flexing or bending in opposite direction as a result of the gas streams being deflected by the rotating blades of paddle wheels 89 and 90. As shown in FIG. 7, each rotating paddle wheel comprises three blades 92, 93 and 94 spaced 120 degrees apart and mounted on a common shaft 95. Paddle wheels 89 and 90 are rotated in phase relative to one another by means of a motor means and appropriate gearing, belting, or the like. The blades of opposed paddle wheels in a given set are preferably positioned so that when a gas stream is deflected by impingement against one of the paddle wheels, a portion of the deflected web segment is received in the space between adjacent blades of the other paddle wheel. By varying the number of blades on the paddle wheels and/or the rotational speed thereof, the intensity of bending vibration or oscillation induced into web 96 moving therebetween can be varied significantly.

Figure 8:
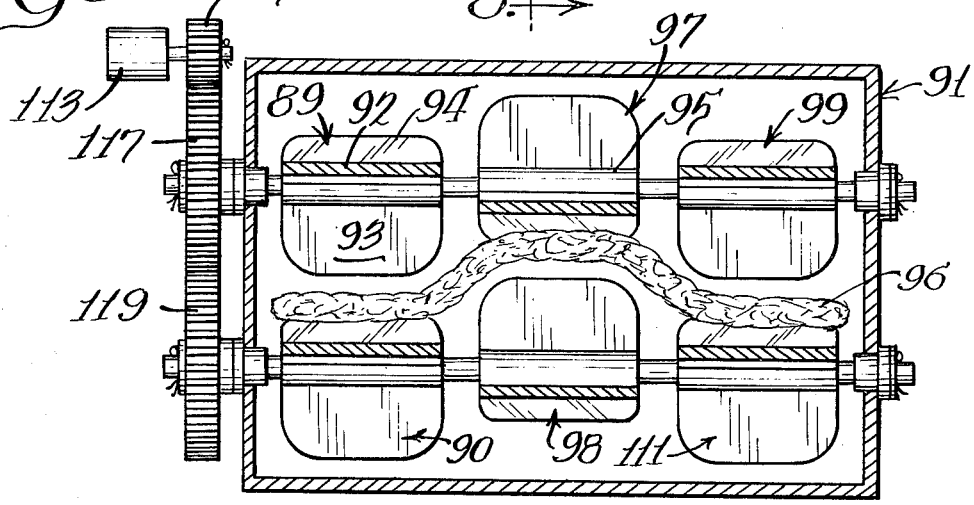
FIG. 8 is a sectional elevation taken along plane 7—7 in FIG. 7.

Each paddle wheel can extend transversely across the entire width of tunnel 91; however, for inducing additional bending oscillations in the cross direction of web 96 as web 96 is transported through tunnel or confined flow passageway 91, a series of paddle wheels having different blade positions can be provided on each shaft as long as the paddle wheels of each opposing set are sufficiently in phase so as to receive web 96 therebetween. Such an arrangement is illustrated in FIG. 8 where opposed paddle wheels 97 and 98 are about 60 degrees out of phase with opposed paddle wheels 89 and 90 but are in phase with one another. The third set of opposed paddle wheels, i.e., paddle wheels 99 and 111, are about 60° out of phase with paddle wheels 97 and 98, but are in phase with opposed paddle wheels 89 and 90. All three sets of paddle wheels shown in FIG. 8 are driven in synchronism by electric motor 113 through gears 115, 177 and 119.

Figure 9:
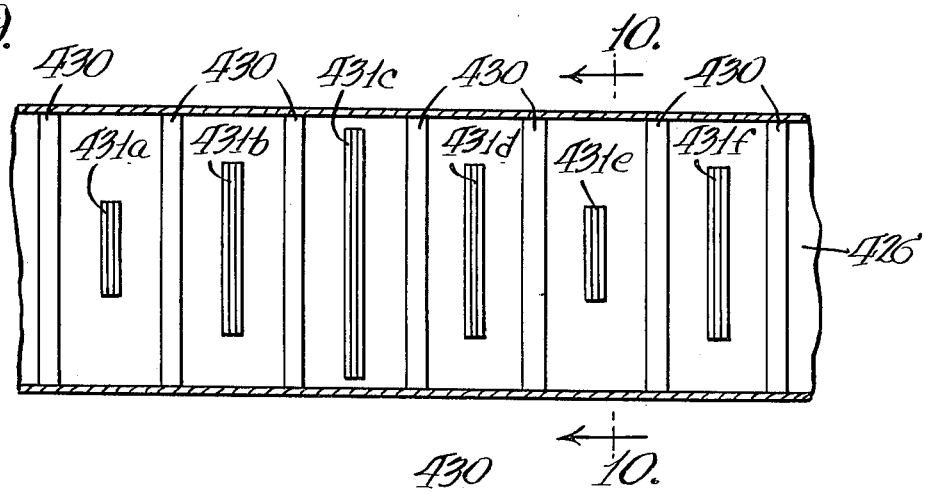
FIG. 9 is a fragmentary plan view of a portion of a tunnel similar to that shown in FIG. 2 but with the top wall removed.
Figure 10:
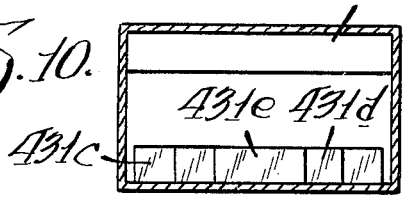
FIG. 10 is a sectional elevation taken along plane 10—10 in FIG. 9.

Bending and flexure can also be imparted to the web in the cross direction by using stationary baffles of unequal length, for example, as shown in FIGS. 9 and 10. In FIG. 9, tunnel 426 is provided with spaced transverse baffles 430 of equal length along the top wall thereof and with spaced transverse baffles 431 *a–f* of varying length along bottom wall 24. The top array of baffles 430 is staggered relative to the bottom array of baffles 431. Also, for any given incremental length of tunnel 426, the length of each successive baffle 431 increases to a predetermined maximum and then decreases to a predetermined minimum. If desired, both the top array and the bottom array of baffles can include baffles of varying length. Again, the baffles can be in the form of separate structural elements mounted on the tunnel walls or the tunnel walls can be provided with appropriate contoured surfaces which serve the same purpose as the baffles.

Because the web is supported by the gas streams passing through tunnel 16, apparatus 10 can also be used for adding treatments or finishes to impart further characteristics to the web segment 12. To this end, spray nozzles 86, 88 (FIG. 1) may be provided in plenums 44, 46 for injecting a web-treating substance such as a liquid, a reactive vapor, a solvent, a plasticizer or particulate matter into the gas streams, which injected materials are carried by the gas streams and are subsequently transferred to web segment 12 in tunnel 16. It is a further feature of the present invention that apparatus 10 can readily be used as a dryer or oven by utilizing one or more heated gas streams between web segment 12 and top wall 22 and/or between web segment 12 and bottom wall 24. In this manner different degrees of drying and/or curing of bonded or laminated products can be obtained to produce a treated web segment 12 with specific properties and characteristics.

Web segments 12 can also be severed or "snapped" by interrupting the gas streams by quickly opening and closing the flow the gas stream through the inlet end 18 of tunnel 16. To accomplish this, valve means 40, 42 may comprise rotating air valves which can be rapidly opened and closed when desired.

Additionally, apparatus 10 may be used to delaminate fabrics made of two plies or other composite laminates which are loosely bonded together, for example, composite webs of the type disclosed in U.S. Pat. No. 3,483,051 to Mesek et al. With severe mechanical and aerodynamic vibrations, the loosely bonded laminates can be separated into two or more webs.

Additional advantages of the present invention are the small amount of space required by apparatus 10 since it can be placed horizontally, vertically, or be curved in shape (FIG. 3), and the small amount of energy consumed by apparatus 10 to improve the characteristics of the web segment 12 undergoing treatment. As disclosed hereinabove with reference to FIG. 5, the distance between baffles 30 and the opposite wall of wall means 14 can be adjusted. Since screws 72, 74 and nuts 80, 82 are provided adjacent both ends of wall means 14, members 48 and 50 can be adjusted and positioned in a converging or diverging relationship, as illustrated in FIG. 2, rather than in the parallel relationship shown in FIGS. 1 and 6. When a diverging tunnel is used, the included angle between top wall 22 and bottom wall 24 is an acute angle and is preferably less than about 30°, and more preferably less than about 15°. For this purpose particularly preferred is an included angle of about 7 degrees. When apparatus 10 is placed vertically, the gas stream can be provided with a lower pressure and flow rate due to the effect of gravity in conveying web segment 12 through tunnel 16.

The baffles along top wall 22 are preferably positioned in offset relationship with respect to the baffles along bottom wall 24 in order to create a tortuous path for both the top and bottom gas streams to obtain the required vibration of the web segment 12 undergoing treatment. As illustrated in FIG. 6, however, the baffles 30 along top wall 22 may be positioned in registration with the baffles along bottom wall 24. When the baffles are in registration web oscillation is relatively dampened or subdued and web segment 12 undergoes surface treatment as a result of the increased gas flow rate along the surface of web segment 12. The resulting relatively high velocity gas stream passing through the constrictions formed by baffles 30 being in registry strips lint and fuzz from the web surface and substantially brushes out loose fibers from the web surface.

A method for modifying the properties of a web segment according to the present invention comprises the steps of providing a confined flow passageway for the web segment and introducing a web segment and a pair of concurrent gas streams into the passageway only at the inlet end thereof. The gas streams are passed through the passageway one on each side of the web segment so that the web segment is supported by the gas streams. At the same time direction of flow for each gas stream within the passageway is periodically altered so that each gas stream alternately impinges onto and oscillates the web segment as the web segment is transported through the passageway.

At least one valve can be provided in the gas supply conduits to vary the pressure of at least one gas stream entering the tunnel. If desired, the pressure of each gas stream can be independently varied by providing a valve for each gas stream conduit. The pressure of the gas stream or streams can also be varied by providing at least one variable blower to direct the gas stream into the passageway.

EXAMPLE

A 14.5 inch wide continuous web of nonwoven fabric produced in accordance with the teachings of U.S. Pat. No. 3,663,348 to Liloia from two plies of randomly oriented blends of predominantly wood pulp fiber and textile length fibers was passed through an apparatus embodying the present invention, and the web properties before and after the treatment were ascertained.

The apparatus comprised a 15 inch wide and 48 inch long diverging confined flow passageway having a plane gap of about 0.5 inch at the inlet end and about 1 inch at the outlet end. The angle of divergence from the horizontal for both the top wall and the bottom wall of the passageway was 36 minutes. The baffles were mounted in spaced, staggered arrays on the top and bottom walls on 4 inch centers. Each baffle was in the configuration of a truncated triangular prism about 3 inches wide at the base, about 2 inches wide at the top, and about 1 inch high.

The face web fiber blend comprised about 75 percent wood pulp and about 25 percent rayon bonded with an acrylic latex binder. Web feed rate was about 250 feet per minute. An air stream was passed on each side of the web at a flow rate of about 750 cubic feet per minute.

Bending stiffness, tensile strength, abrasion resistance and delamination strength of the web were determined before and after the foregoing treatment and are reported in Table I hereinbelow.

TABLE I

| Property | Untreated Fabric | Treated Fabric |
|---|---|---|
| Bending Stiffness | | |
| Machine Direction | 1918 mg.cm. | 1504 mg.cm. |
| Cross Direction | 815 mg.cm. | 543 mg.cm. |
| Tensile Strength | | |
| Machine Direction | 3.10 lbs./in. | 3.02 lbs./in. |
| Cross Direction | 1.60 lbs./in. | 1.64 lbs./in. |
| Abrasion Resistance | 560 strokes | 572 strokes |
| Delamination Strength | 0.09 PSI | 0.095 PSI |

The above data show that a reduction in bending stiffness of about 22 percent in the machine direction and about 33 percent in the cross direction can be achieved without reduction of tensile strength in either the machine direction or the cross-direction, and without causing a decrease in the web abrasion resistance and delamination strength.

The foregoing description and the drawings are illustrative but are not to be taken as limiting. Still other variations and modifications are possible without departing from the spirit and scope of the present invention.

I claim:

1. Apparatus suitable for treating a flexible web segment by oscillation so as to modify the properties of said segment which comprises wall means defining an elongated tunnel adapted to receive a web segment having at least two substantially opposing wall surfaces, and having an inlet end and an outlet end;

an array of spaced baffles positioned substantially transversely in said tunnel along each of said opposing wall surfaces;

first and second gas feed means only at said inlet end for introducing a pair of substantially concurrent gas streams into said tunnel;

said baffles in one array being positioned in a staggered relationship relative to the baffles in the other array, and said gas feed means being positioned to impinge a first gas stream against said one array and to impinge a second gas stream against said other array, said baffles deflecting the respective gas streams against said web segment such that said first gas stream deflects said web segment in a first direction and said second gas stream deflects said web segment in the opposite direction, with said web segment being alternately deflected in said opposite directions to oscillate the web segment with a severity and frequency sufficient to mechanically alter the properties thereof; and web feeding means for feeding said web segment through said apparatus between said opposing wall surfaces, said feeding means comprising said pair of gas streams.

2. Apparatus as defined in claim 1 wherein the baffles in said one array are substantially parallel to one another and the baffles in said other array are substantially parallel to one another.

3. Apparatus as defined in claim 2 wherein said baffles are wedge-shaped.

4. Apparatus as defined in claim 1 wherein said wall means comprises an elongated top wall, an elongated substantially opposing bottom wall, and first and second elongated side walls generally perpendicular to said top and bottom walls and connected therewith, said one array of baffles being positioned along said top wall and said other array of baffles being positioned along said bottom wall.

5. Apparatus as defined in claim 4 wherein said baffles project into said tunnel for a distance which is less than one-half of the transverse dimension between said top wall and said bottom wall.

6. Apparatus as defined in claim 4 wherein said top wall and said bottom wall are substantially parallel.

7. Apparatus as defined in claim 1, wherein said first and second gas feed means each comprise a gas conduit, a plenum communicating with said gas conduit and provided with an orifice for introducing a gas stream into said tunnel, and gas flow control means associated with said conduit.

8. Apparatus as defined in claim 7 wherein said gas flow control means is independently variable to adjust the velocity of each of said gas streams within said tunnel.

9. Apparatus as defined in claim 1 further including means for injecting a web treating substance into said gas streams whereby said substance is transferred to said web in said tunnel.

10. Apparatus suitable for subjecting a flexible web segment to bending or flexing in opposite directions which comprises wall means defining an elongated confined flow passageway having an inlet end and an outlet end and adapted to receive said flexible web segments;

first and second gas feed means situated only at said inlet end for introducing into said confined flow passageway a gas stream on each side of said flexible web segment, said introduced gas streams being substantially concurrent;

gas stream deflector means comprising baffles positioned on opposite sides of said web, in staggered relationship with respect to each other and substantially transversely across said confined flow passageway and spaced from one another so to permit transport of said flexible web segment therebetween, and alternately deflecting said introduced gas stream for impingement against said flexible web segment so as to oscillate said flexible web segment with sufficient severity to modify the physical characteristics thereof.

11. A method for modifying properties of a web segment which comprises the steps of providing a confined flow passageway for said web segment, said passageway having an inlet and an outlet;

introducing said web segment into said passageway;

introducing a pair of substantially concurrent gas streams into said passageway only at the inlet end of said passageway, one of said gas streams being introduced on one side of said web segment and another of said gas streams being introduced on the other side of said web segment;

passing said gas streams through said passageway on each side of said web segment so that the web segment is supported by the gas streams and transported through said passageway;

providing a pair of arrays of spaced baffles in said passageway and substantially transverse thereto, said baffles in one array being positioned on one side of said web segment and in a staggered relationship relative to the baffles in the other array on the opposite side of the web segment;

periodically altering the instantaneous direction of flow for each gas stream within the passageway by impinging said gas streams against said arrays, and alternately deflecting said web segment in opposite directions to oscillate said web segment with a severity and frequency sufficient to mechanically alter the properties thereof by further impinging said one gas stream against said web segment to deflect said web segment in a first direction, and further impinging the other of said gas streams against said web segment to deflect said web segment in the opposite direction as said web segment is transported through said passageway.

12. A method as defined in claim 11 further including the step of varying the pressure of at least one of said gas streams in said passageway.

13. A method as defined in claim 11 further including the steps of providing at least one variable blower communicating with said inlet and varying the velocity of at least one of said gas streams by varying the speed of said blower.

14. A method as defined in claim 11 further including the steps of positioning an array of spaced baffles in said passageway on opposing walls thereof and impinging said gas streams against said baffles so as to alter the instantaneous direction of flow for each gas stream.

15. A method as defined in claim 11 further including the step of injecting a web-treating substance into said gas streams so as to deposit said substance onto said web segment in said passageway to further modify the properties thereof.

16. A method for modifying the properties of a web having a plurality of laminates which comprises the steps of:

providing a confined flow passageway for said web segment, said passageway having an inlet and an outlet;

introducing said web segment into said passageway;

introducing a pair of substantially concurrent gas streams into said passageway only at the inlet end of said passageway, one of said gas streams being introduced on one side of said web segment and another of said gas streams being introduced on the other side of said web segment;

passing said gas streams through said passageway on each side of said web segment so that the web segment is supported by the gas streams and transported through said passageway;

providing a pair of spaced baffles in said passageway and substantially transverse thereto, said baffles in one array being positioned on one side of said web segment and in a staggered relationship relative to the baffles in the other array on the opposite side of the web segment;

periodically altering the instantaneous direction of flow for each gas stream within the passageway by impinging said gas streams against said arrays, and alternately deflecting said web segment in opposite directions to oscillate said web segment with a severity and frequency sufficient to separate said web segment into at least substantially coextensive web portion by further impinging said one gas stream against said web segment to deflect said web segment in a first direction, and further impinging the other of said gas streams against said web segment to deflect said web segment in the opposite direction as said web segment is transported through said passageway.

* * * * *

UNITED STATES PATENT OFFICE

CERTIFICATE OF CORRECTION

Patent No. 4,055,003 Dated October 25, 1977

Inventor(s) Georges H. Sack

It is certified that error appears in the above-identified patent and that said Letters Patent are hereby corrected as shown below:

Column 3, line 20, after "stiffness," insert -- drape, --.

Column 4, line 40, "wal" should read -- wall --.

Column 6, line 26, "177" should read -- 117 --.

Signed and Sealed this

*Eighteenth* Day of *July 1978*

[SEAL]

*Attest:*

RUTH C. MASON
*Attesting Officer*

DONALD W. BANNER
*Commissioner of Patents and Trademarks*